United States Patent [19]

Gilman

[11] Patent Number: 4,534,126

[45] Date of Patent: Aug. 13, 1985

[54] CHECK-OUT COUNTER DIVIDER

[76] Inventor: Harry Gilman, 8 Rose Ave., Marblehead, Mass. 01945

[21] Appl. No.: 590,803

[22] Filed: Mar. 19, 1984

[51] Int. Cl.[3] ..... G09F 3/18

[52] U.S. Cl. ..... 40/19; 40/10 D

[58] Field of Search ..... 40/19, 358, 905, 10 D, 40/10 R; D21/100

[56] References Cited

U.S. PATENT DOCUMENTS

| | | | |
|---|---|---|---|
| 719,597 | 2/1903 | Lee | 40/19 |
| 1,553,702 | 9/1925 | MacLearen | 40/19 |
| 1,854,908 | 4/1932 | Northrup | 40/19 |
| 2,677,901 | 5/1954 | Tilleman | 40/19 |
| 2,797,512 | 7/1957 | Sieve | 40/358 |
| 3,306,266 | 2/1967 | McCunney | 40/10 R |
| 3,662,080 | 5/1972 | Hale et al. | D21/100 |

FOREIGN PATENT DOCUMENTS

| | | | |
|---|---|---|---|
| 1442300 | 7/1976 | United Kingdom | 40/19 |

*Primary Examiner*—John J. Wilson
*Assistant Examiner*—Cary E. Stone
*Attorney, Agent, or Firm*—Wolf, Greenfield & Sacks

[57] ABSTRACT

A check-out counter divider. The counter divider includes an elongated hollow body defining an elongated opening and having a plurality of faces which are at least partially transparent to visible light for displaying advertising positioned within the opening from all faces of the divider. Removable closures on each end of the body allow easy replacement of the advertising within the body. The closures are skid-resistant and a weight is disposed within the body so that the counter divider resists rolling and displacement.

8 Claims, 2 Drawing Figures

CHECK-OUT COUNTER DIVIDER

FIELD OF THE INVENTION

This invention relates to a check-out counter divider.

BACKGROUND OF THE INVENTION

Dividers are frequently used on store check-out counters between customer's goods to help the check-out sales personnel distinguish the goods of different customers. These dividers are typically sticks or rods and sometimes are imprinted with the store name. For the most part, these rods are unattractive and have no function other than as a divider. Those dividers which bear the store name generally become so worn and discolored during use that the store name is unattractively displayed.

SUMMARY OF THE INVENTION

It is an object of the present invention to provide a divider for a check-out counter which functions both as a divider and as an advertising medium.

Another object is to provide such a counter divider which permits the advertising associated with the divider to be changed.

Another object is to provide a counter divider having a plurality of faces for displaying advertising material from each face of the divider.

Another object is to provide such a counter divider for displaying advertising from a plurality of faces which necessarily is handled by the customer.

Another object is to provide a counter divider that can be manufactured easily and economically.

Still another object is to provide a counter divider having removable, skid-resistant end closures.

Another object is to provide a counter divider which is weighted so as to resist rolling or displacement once positioned between the goods of successive customers.

In one embodiment of the invention, an elongated hollow body defines an elongated opening and has a plurality of faces which are at least partially transparent to visible light for displaying advertising material positioned within the opening from all faces of the body. Removable closures on each end of the body facilitate easy replacement of the advertising material within the body. Preferably, the closures are skid-resistant and a weight is positioned within the opening to prevent rolling or displacement of the body.

Other objects and advantages of the invention will be more fully understood from the accompanying drawings and the following description of several illustrative embodiments and the following claims. It should be understood the terms such as "upper," "lower," "above," and "below" used herein are for convenience of description only and are not used in any limiting sense.

DETAILED DESCRIPTION OF THE PREFERRED EMBODIMENTS

Figure 1:
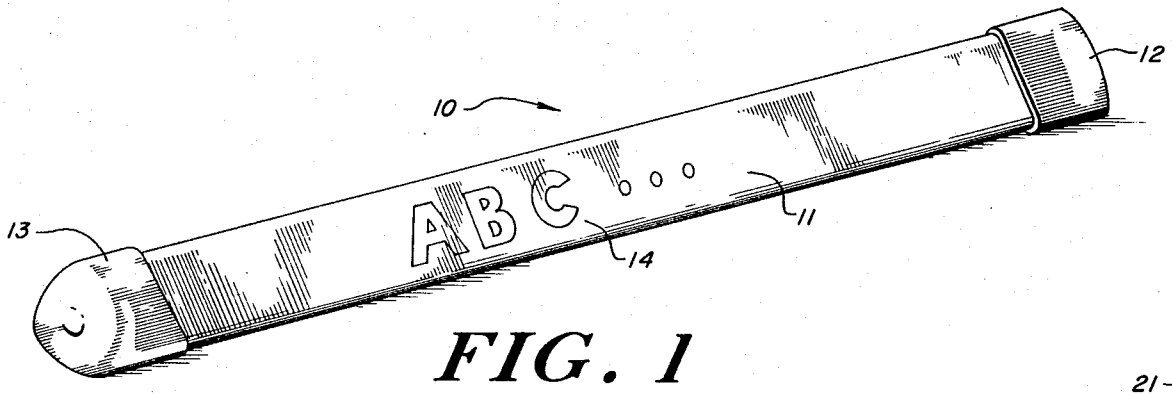
FIG. 1 is a perspective view of the counter divider of the invention.
Figure 2:
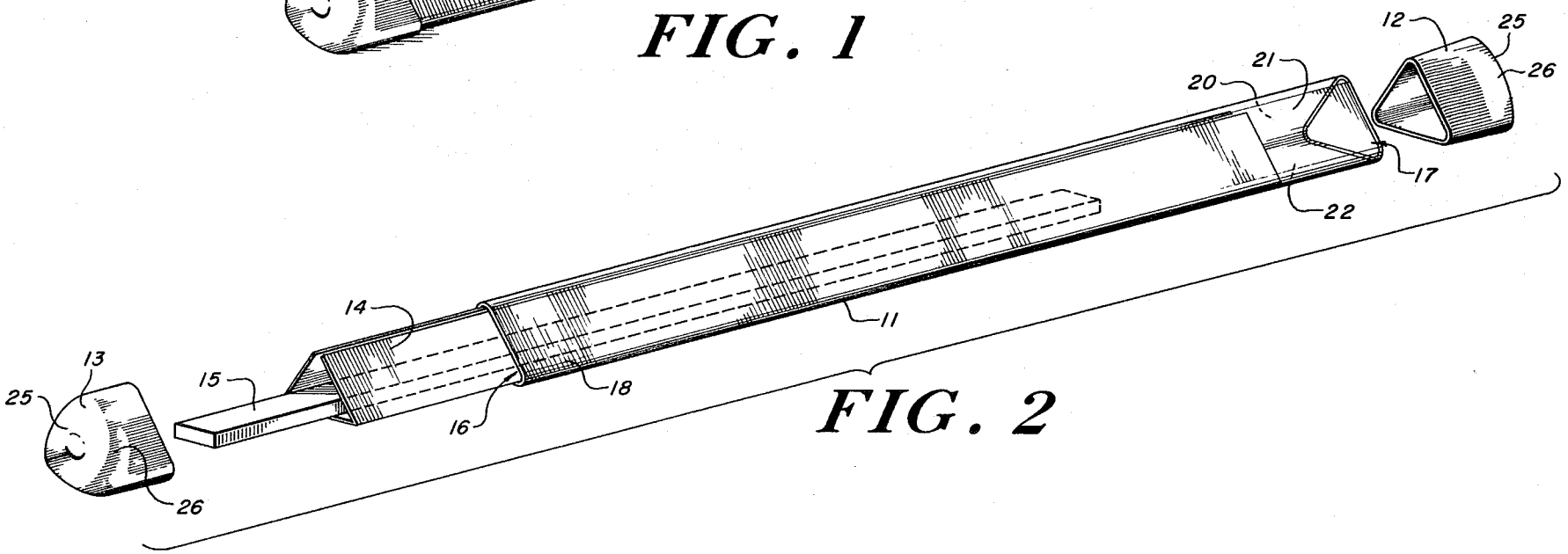
FIG. 2 is an exploded perspective view of the components of the counter divider of the invention.

FIGS. 1 and 2 show a preferred embodiment of the counter divider 10 of this invention. Counter divider 10 includes a body 11, closures 12 and 13, and weight 15.

An elongated hollow body 11 defines an elongated opening 16 and has two ends 17 and 18 and a plurality of faces, e.g., 20, 21, and 22. Body 11 is shown for illustrative purposes only as substantially triangular in cross section and thus having three faces. Body 11 may be of any cross-sectional shape such that a plurality of faces for displaying advertising extend above a base, the base being that face or faces positioned on the counter. The faces 20, 21, and 22 of body 11 may be generally planar or curved. Preferably the edges between the faces are smooth and rounded so as not to injure a person handling the divider. Body 11 is made from a material which is at least partially transparent to visible light, such as a clear plastic, and preferably is made by extruding polystyrene or acrylic plastic.

Positionable within body 11 is advertising material 14 which may comprise a multisided member such as a sheet of folded paper, cardboard or the like having a message printed thereon. Advertising material 14 is shaped to be slidably disposed within opening 16 and preferably is shaped to lie adjacent the interior surfaces of the faces 20, 21, and 22 of body 11. Advertising material 14 is visible through the faces of body 11.

Closures 12 and 13 are made of a flexible material such as vinyl and are sized and shaped to frictionally engage ends 17 and 18 of body 11. Each closure has an end wall 25 and a means, such as a lip 26, for attachment to body 11. The cross section of closures 12 and 13 substantially corresponds to the cross section of body 11 and thus are shown in FIGS. 1 and 2 as substantially triangular. Preferably, closures 12 and 13 have rounded edges so as not to injure a person handling the divider. Closures 12 and 13 retain advertising material 14 within opening 16 of body 11 but are easily removable to facilitate insertion and removal of advertising material 14 within opening 16. Closures 12 and 13 are preferably made of a skid-resistant material to prevent rolling or displacement of counter divider 10 once positioned between the goods of various customers. Vinyl and rubber are suitable skid-resistant materials.

A weight 15 is disposed within opening 16 to prevent the counter divider 10 from rolling and to resist displacement. Preferably, weight 15 is positioned within the space defined by the sides of advertising material 14 so as not to interfere with the display of advertising material 14. Weight 15 may be a bar of plastic of approximately the same length as body 11.

To assemble the counter divider 10, advertising material 14 is inserted through one end of body 11 into opening 16 to lie adjacent the interior surfaces of the faces of body 11. Weight 15 is also inserted in opening 16. Closures 12 and 13 are placed on the ends of body 11. The divider is then placed on the counter and the advertising is readily viewable from each face of the divider extending above the counter. Any face of the body may serve as the base and all other faces serve to display advertising. To replace advertising material 14, either closure 12 or 13 is removed from one end of body 11 allowing the removal of advertising material 14 and replacement of a substitute advertising.

Counter divider 10 thus comprises a minimum of components and can be easily and economically manufactured. Advertising is readily viewable from all faces of the divider and the advertising may be readily replaced. The divider is lightweight and movable, but due to its shape, skid-resistant closures 12 and 13, and weight 15, will not roll or be easily displaced once placed into position between the goods of different customers. The advertising is protected from wear and will retain a fresh appearance. The rounded corners of body 11 and closures 12 and 13 will not injure the person handling the divider. The counter divider is strong and will resist fracture if dropped during handling.

Although the invention has been described above by reference to several embodiments, many additional modifications and variations thereof will now be apparent to those skilled in the art. Accordingly, the scope of the invention is to be limited not by the details of the illustrative embodiments described herein, but only by the terms of the appended claims and their equivalents.

I claim:

1. A check-out counter divider comprising:

an elongated hollow body defining an elongated opening and having a plurality of planar faces; said faces being at least partially transparent to visible light;

advertising material positioned within said opening and visible through said faces;

removable closures on each end of said body to facilitate insertion and removal of said advertising material from within said opening, said closures being made of a skid-resistant material to prevent rolling or displacement of said divider; and a shiftable weight disposed within said opening to prevent rolling or displacement of said divider.

2. The counter divider of claim 1 wherein said advertising material comprises a multisided member that is positionable adjacent the interior surfaces of each of said faces.

3. The counter divider of claim 2 wherein said closures are made of a flexible material and are sized and shaped to frictionally engage said ends of said body.

4. The counter divider of claim 3 wherein said weight is disposed within said advertising material.

5. The counter divider of claim 4 wherein said weight comprises an elongated bar of substantially the same length as said body.

6. The counter divider of claim 4 wherein said body and said closures have a substantially triangular cross section and rounded edges.

7. The counter divider of claim 6 wherein said body is made of a clear plastic.

8. The counter divider of claim 7 wherein said closures are made of vinyl.

* * * * *